US005477800A

United States Patent [19]

Lawrence

[11] Patent Number: 5,477,800

[45] Date of Patent: Dec. 26, 1995

[54] COMBINATION DOCK CLEAT AND CHOCK

[76] Inventor: Alan P. Lawrence, 314 Walnut St., Newport Beach, Calif. 92663

[21] Appl. No.: 363,895

[22] Filed: Dec. 27, 1994

[51] Int. Cl.[6] ..... B63B 21/04

[52] U.S. Cl. ..... 114/218

[58] Field of Search ..... 114/218, 381, 114/230; 24/115 R, 129 R; D8/356

[56] References Cited

U.S. PATENT DOCUMENTS

| | | | |
|---|---|---|---|
| 120,131 | 10/1971 | Trulsen | D54/11 |
| D. 179,328 | 11/1956 | Stewart | D8/356 |
| D. 191,885 | 12/1961 | Corlett | D8/356 |
| D. 227,216 | 6/1973 | Miller | D8/356 |
| D. 227,217 | 6/1973 | Dick | D8/356 |
| D. 239,258 | 4/1975 | Faul | D8/232 |
| D. 255,419 | 6/1980 | Hume | D8/382 |
| D. 299,311 | 4/1989 | Whitley, II | D8/356 |
| D. 300,721 | 4/1989 | Whitley, II | D8/356 |
| D. 301,683 | 6/1989 | Whitley, II | D8/356 |
| 1,291,341 | 1/1919 | Young | 114/218 |
| 2,870,733 | 1/1959 | Winther . | |
| 3,126,858 | 3/1964 | Rosinski | 114/218 |
| 4,270,478 | 6/1981 | Kafka | 114/218 |
| 4,344,378 | 8/1982 | Martin | 114/218 |

*Primary Examiner*—Ed Swinehart

[57] ABSTRACT

A device to secure a boat to a dock with a rope in a conventional manner, using two horizontally protruding horns (14) extending in opposite directions and two smooth curved surfaces (12) below each of the horns to guide the rope. Another protruding horn with a smooth guiding surface below it faces each of the other two horns and guiding surfaces, which allows a person to guide the rope from either direction without removing the rope from the device and moving it to the other end as is required with a conventional cleat. Two sloping surfaces (13) on the ends of the device are parallel to the direction a person would normally be walking on a dock and are designed to deflect a moving foot away from the Protruding horns of the device, reducing the liklihood of injury caused by striking the device.

1 Claim, 2 Drawing Sheets

COMBINATION DOCK CLEAT AND CHOCK

BACKGROUND-CROSS REFERENCE TO RELATED APPLICATIONS

A patent application filed concurrently with this application, entitled "Safety Adaptor Standard Dock Cleat".

1. Field of Invention

This invention relates to the standard cleat used on boat docks and marinas to secure a boat to the dock, specifically to a modification which will make such cleats safer and easier to use.

2. Description of Prior Art

Although there have been many types of dock cleats patented, nearly all dock cleats in use in the United States today are the type which utilizes two horizontally protruding horns, extending in opposite directions. These two horns, attached to a common base, provide a surface which a line or rope can be tied or wrapped around, the other end of the rope being attached to the boat. The horizontally protruding horns are generally blunted, with a diameter of about ½ inch and are two or three inches above the surface of the dock, depending on the size of the cleat.

This type of cleat is simple and effective. The way it is used is generally understood by anyone who has any boating experience, and even a person unfamiliar with it can usually determine an effective way to secure a line or rope to the cleat.

One problem with this type of cleat is that the horizontally protruding horns must be oriented so that it is possible for a person walking along the dock to strike or kick the end of the cleat with his foot, which is usually painful and can cause serious injury.

This problem has been previously addressed in two ways.

One approach, for which a number of patents have been issued, makes use of folding or retractable cleats. Folding or retractable cleats do eliminate any danger of injury when they are in the retracted position, that is, when they are not being used. In order to use them, however, they must be exposed, resulting in the same hazard as standard cleats.

Because they involve moving parts they are more complicated and relatively expensive. Moving parts tend to jam or become inoperable either as a result of corrosion or due to the abuse they are subjected to. Installation is much more complicated since recesses must usually be cut into the dock. Also, some people attempting to use the cleats may not know how to "unfold" them.

The other approach used by previous inventors has been to redesign the cleat or to create a new cleat design which will effectively hold the boat but which has no protruding ends. Although many of these designs may work quite well, the average boater would not know how to use them. The education in their use that is required and the fact that they are not what people are used to is undoubtedly the major cause of the lack of commercial success of any cleat design which departs significantly from the standard type currently in use.

OBJECTS AND ADVANTAGES

Accordingly, several objects and advantages of the invention are as follows:

(a) The combination dock cleat and chock shields the point of the horizontally protruding horn so it cannot be directly struck by the foot of a person walking on the dock. The new design has a smooth sloping surface on each end of the dock cleat, which is where it would be kicked or struck. This surface is designed to deflect the foot, thereby preventing injury.

(b) The new design does not change how the dock cleat is used. The basic configuration and the method of securing the line to the cleat remain the same so that anyone familiar with a standard dock cleat will have no trouble using the combination dock cleat and chock.

(c) The new design is design to be installed in the same manner as existing standard dock cleats.

(d) There are no moving parts to stick, jam or become inoperable due to corrosion, a particular problem in a salt-water environment.

(e) The new design is equally effective whether the dock cleat is in use or not.

(f) The curved inner surfaces of the combination dock cleat and chock provide two additional surfaces on which to apply force to the line to help secure the boat, allowing the force to be applied in either direction without removing the line from the dock cleat, as must be done with a standard dock cleat.

DRAWING FIGURES

FIG. 1 is a top plan view of a combination dock cleat and chock.

FIG. 2 is a front elevational view of a combination dock cleat and chock.

FIG. 3 is a bottom plan view of a combination dock cleat and chock.

FIG. 4 is a isometric view of a combination dock cleat and chock.

Reference Numerals in Drawings

Figure 1:
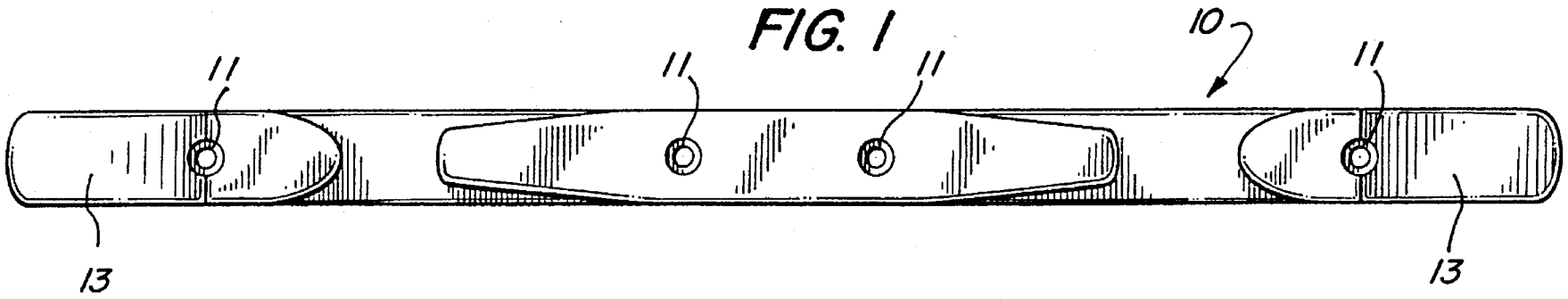
FIGS. 1 to 4 show a combination dock cleat and chock.
Figure 2:
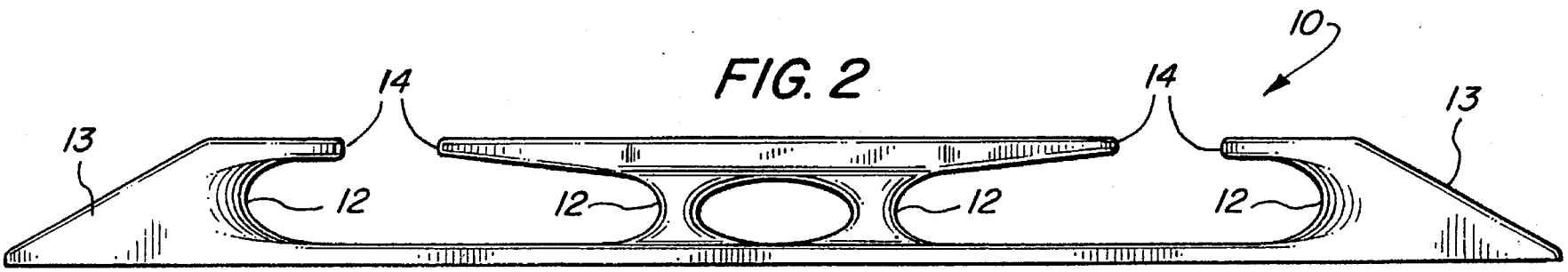
Figure 3:
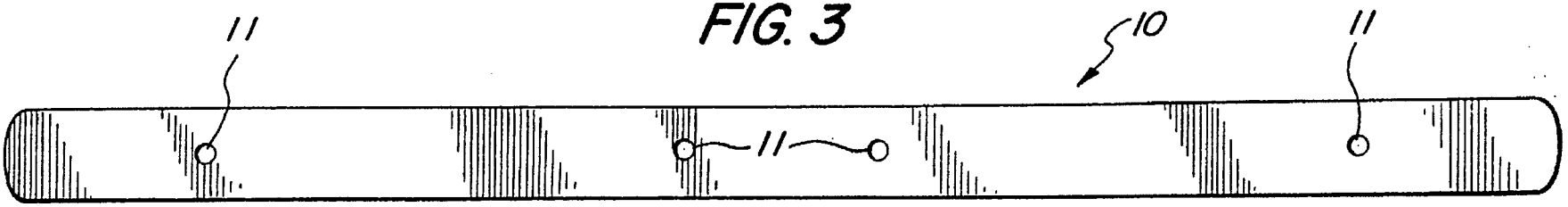

10 a typical combination dock cleat and chock

11 hole for bolt used to secure adaptor to dock

12 curved inner surface for guiding rope

13 smooth surface to deflect foot

14 horizontally protruding horn

16 the surface of the dock to which the combination dock cleat and chock is attached

DESCRIPTION-FIG. 1 TO 4

FIG. 1 to 4 show a typical combination dock cleat and chock 10. The typical size of such a device would be two or three inches high, with the size of the center portion of the device roughly corresponding to the typical sized standard dock cleat. Applications which require a larger (or smaller) standard dock cleat would use a combination dock cleat and chock which was proportionally larger (or smaller).

The combination dock cleat and chock can be made of any material strong enough to secure the boat and compatible with an outdoor marine environment, i.e., any material which is used to make standard dock cleats. Nearly all dock cleats are made with galvanized steel, although stainless and other metals, plastics, and even wood are also used.

The combination dock cleat and chock consists of a central portion with two horizontally protruding horns 14 on a central base, with two curved inner surfaces 12 below the horns in the same configuration as a standard dock cleat. On the outer portions of the device, facing each of the two central protruding horns, is another horizontally protruding horn of a similar size and shape. The points of the horns face each other. The distance between them is two or three times the diameter of the largest sized rope likely to be be used on the device. On a typical recreational marina this distance would be about two inches.

Below each of the outer horns there is a curved inner surface 12 similar to the ones below the central horns. This surface is more or less vertical, and like the corresponding surface below the center horns, it is used to guide the rope being used to control the boat, and to gain mechanical advantage and leverage on the rope.

The space between each of the inner and outer horns and the curved surfaces is roughly symmetrical about the center line of the space between the the points of the horns. It is not necessary that the space be exactly symmetical, only that each side has the same general configuration.

The extreme outer ends of the combination dock cleat and chock, the ends facing away from the center of the cleat, consist of a smooth, sloped surface 13 with no edges or corners which could injure someone's foot. The surface is designed to deflect the foot without causing injury.

The device would normally be secured to the dock by lag bolts or through bolts, so holes 11 are provided for that purpose. Typically, the bolt holes are countersunk so the heads of the bolts can be installed flush with the top surface of the device.

OPERATION-FIG. 4

A typical marina will have numerous dock cleats located around any place a boat is to be secured. Lines or ropes are fastened to the boat and then wrapped over and around the two horizontally protruding horns and the two curved inner surfaces below the horns of the ordinary cleat. In addition, the curved inner surfaces are often used to guide the ropes as the boat is pulled into position.

The dock cleats are normally located so that the horizontal horns extend parallel to the edge of the dock, and therefore are pointing towards the feet of a person walking along the dock, and that person is swinging his feet towards the point of the horn as he walks. Due to the activity and visual distractions often found in a boating environment, a person walking on a dock sometimes swings his foot directly into the point of the horn on the dock cleat, which is usually painful and can cause injury.

Figure 4:
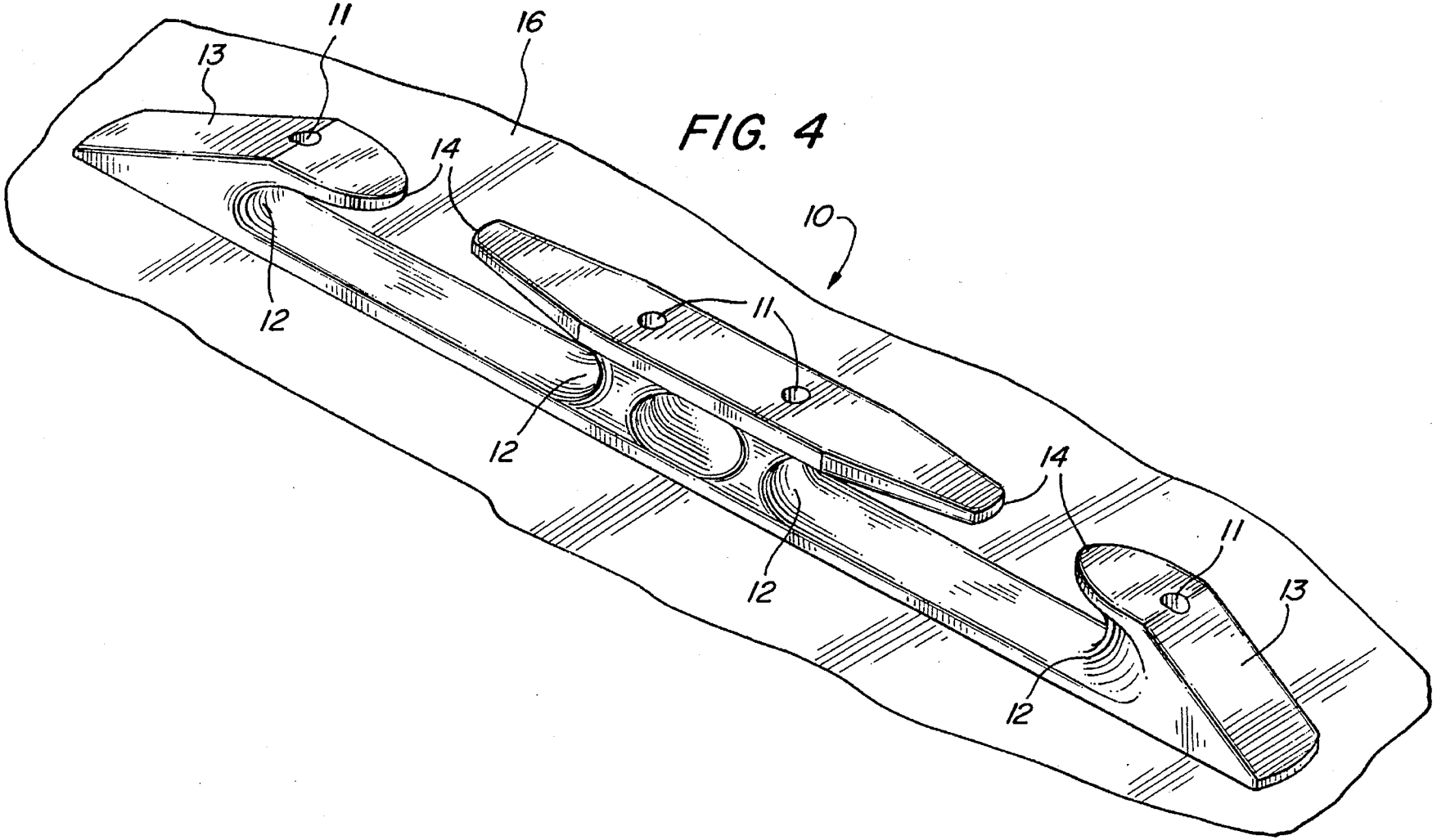

By replacing the standard dock cleats with the combination dock cleat and chock 10 as shown in FIG. 4, this hazard is eliminated. There are no more unprotected horizontally protruding horns which can be struck with a foot. Each end of the device, the end facing the swinging foot of someone walking along the dock, has a smooth, sloped surface 13 designed to deflect the foot, minimizing the chance of injury.

Striking the device from the side, perpendicular to the edge of the dock is far less likely. Generally docks are quite narrow and can be crossed in one or two steps. A person does not normally travel perpendicular to the edge of the dock, and in the event they did, they would usually be very aware of the edge of the dock and would not be "walking" but only taking a short step or two. And, in any case, there are no protruding horns sticking out in that direction.

Below the each of the four protruding horns 14 on the combination dock cleat and chock 10 is a smooth, curved surface 12. These curved inner surfaces provide additional surfaces which can be used to provide mechanical advantage and to guide the rope or line being used to pull the boat into position. The standard dock cleat provides two surfaces for this purpose, one below each horn and facing in opposite directions. On a normal dock cleat, one surface or the other is used to guide the line, depending on whether the boat is behind or in front of the cleat. However, if one surface is being used and the boat moves past the cleat it is necessary to switch the line to the other surface, which means the line must be removed from the cleat and moved to the other side, which results in temporary loss of control of the line. With the combination dock cleat and chock, an opposing surface is located directly across from each one on the standard dock cleat, so the boat can be controlled from either direction without removing the line.

The combination dock cleat and chock 10 would normally be fastened to the dock by lag bolts or through bolts extending through holes 11 and into the dock.

SUMMARY, RAMIFICATION AND SCOPE

The combination dock cleat and chock greatly reduces the possibility of injury that can be caused by kicking or striking the horizontally protruding horns of the standard dock cleat by providing an smooth, sloping surface to shield the protruding horn and deflect the foot from it.

It also provides two additional surfaces to provide mechanical advantage and support for a line, and to help guide the line and control movement of the boat at the other end of the line. It is designed to be installed in the same manner as existing dock cleats. There are no moving parts and it is used the same way a standard dock cleat is used.

Although nearly all dock cleats utilize two horizontally protruding horns and have the same general configuration there can be considerable variation in relative proportions, surface angles, the radius of curves and corners, etc. The proportions, angles, and curves of the combination dock cleat and chock can vary considerably as well, as long as they provide proper protection to someone's foot and adequate purchase and control of the rope being used.

Thus the scope of the invention should be determined by the appended claims and their legal equivalents, rather than the examples given.

I claim:

1. A device for securing a rope to a dock one end of said rope being attachable to a boat, comprising:

a. four horizontally aligned protruding horns around which said rope may be wrapped, b. a smooth curved surface below each said protruding horn which can be used to guide said rope and aligned so that said rope can be guided from either direction without removing said rope from said device, c. smooth, sloping surface positioned at each end of the device, and shaped so said sloping surfaces will deflect a moving object upwardly and over said device so as to avoid injury.

* * * * *